United States Patent [19]

Müller

[11] 3,942,263

[45] Mar. 9, 1976

[54] METHOD AND APPARATUS FOR COOLING OF HOT BULK MATERIALS

[75] Inventor: Hermann Müller, Frankfurt am Main, Germany

[73] Assignee: Dravo Corporation, Pittsburgh, Pa.

[22] Filed: Jan. 6, 1975

[21] Appl. No.: 538,526

Related U.S. Application Data

[63] Continuation of Ser. No. 417,262, Nov. 19, 1973, abandoned.

[52] U.S. Cl. ..... 34/20; 432/4

[51] Int. Cl.[2] ..... G30B 3/30

[58] Field of Search ..... 34/20, 23, 24, 13, 62, 34/148, 64–67, 184–188; 266/21; 165/65, 120; 432/4, 17, 77, 78

[56] References Cited

UNITED STATES PATENTS

| | | | |
|---|---|---|---|
| 2,480,726 | 8/1949 | Greyson | 34/20 |
| 2,641,064 | 6/1953 | Foner | 34/20 |
| 3,667,133 | 6/1972 | Lincoln | 34/20 |
| 3,739,495 | 6/1973 | Cremer et al. | 432/77 |

*Primary Examiner*—John J. Camby
*Assistant Examiner*—Henry C. Yuen
*Attorney, Agent, or Firm*—Parmelee, Miller, Welsh & Kratz

[57] ABSTRACT

A method and apparatus is detailed for cooling hot bulk material disposed in gas-permeable cooling buckets which travel from a charging zone to a discharge zone, with the cooling buckets in communication with a plenum chamber having integral blower means for forcing cooling gas through the bulk material. The volume of cooling gas forced through the bulk material proximate the charging zone is substantially less than the volume of cooling air which is forced through the bulk material over the rest of the travel path. This results in a substantial reduction in the particulate emission from the bulk material. A cooling gas throttling means is disposed in the plenum chamber between the charging zone and the discharge zone for restricting the volume of cooling gas at specific areas along the travel path.

4 Claims, 5 Drawing Figures

METHOD AND APPARATUS FOR COOLING OF HOT BULK MATERIALS

This is a continuation of application Ser. No. 417,262, filed Nov. 19, 1973 and now abandoned.

BACKGROUND OF THE INVENTION

The invention concerns a process for cooling hot bulk materials in open coolers with gas-permeable cooling buckets moving on a straight or circular track, whereby a gaseous cooling media is forced through the material resting in the buckets.

It is the purpose of the process and apparatus of the present invention to reduce the dust nuisance occuring near cooling apparatus of this type. Such cooling apparatus are well known for different materials, especially sintering cooling apparatus, wherein a gaseous media is forced through the material disposed in the cooling buckets. The magazine Stahl Und Eisen 87, 1967, No. 24, Pages 1472–1477, contains a description of such a cooling apparatus. The cooling apparatus described in the above mentioned article has a circular track with ten cooling air supply ducts in ten separate identical blowers disposed about the circumference of the cooling apparatus. The relatively cool ambient air sucked in by the blowers penetrates the material from below or from the side of the buckets and passes through the bulk material. A uniform volume of cooling air is passed through the hot bulk material along the entire length of the cooling apparatus. The air, heated during penetration of the hot material, carries dust particles from the material into the surrounding area resulting in a severe nuisance. It has been noticed that the ejected quantity of dust or particulate emission is 50 to 100 times greater at the charging end of the cooling apparatus than at the discharge end. The operator of such a cooling apparatus is forced to collect the emitted dust directly above the cooling buckets for separation in an electrostatic or mechanical dust removal apparatus. The abrasive and corrosive dust particles of the sinter plant can cause considerable wear in the duct work. It is the object of this invention to reduce the dust emission from the bulk material during the cooling process, and to obviate the need for any additional dust collector. This is achieved by increasing the volume of cooling media per unit area which is forced through the hot bulk material from the charging end of the cooling apparatus to the discharge end of the cooling apparatus. The hot bulk material as it is charged to the cooling apparatus has a temperature of about 700° to 900°C, and a reduced volume of cooling air is forced through the material at the charging end than at the discharge end of the cooling apparatus. Due to the large temperature difference between the hot bulk material which is at 700° to 900°C and the ambient cooling air which is at from 10° to 30°C, good heat exchange is achieved even with the reduced cooling air volume and cooling air velocity penetrating the bulk material. The bulk material is cooled down to a temperature of about 80° to 100°C proximate the discharge end of the cooling apparatus. While there is a low temperature differential between the material at the discharge end and the cooling air, the resulting lower rate of heat exchange is offset by the higher volume of cooling air and the resultant increased flow through the material layer. Surprisingly, it has been discovered that at the same cooling capacity the amount of dust emitted from the bulk material proximate the charging end of the cooling apparatus can be remarkably reduced and is more uniformly distributed over the entire travel path of the cooling apparatus when the volume of cooling air is reduced proximate the charging zone. It has also been discovered that the particle size of the dust which is evolved proximate the discharge end using the present invention is considerably smaller than the average particle size of dust evolved from a prior art cooling apparatus. The volume of cooling air forced through the bulk material can be increased over the length of the cooling apparatus, or distinct zones can be defined wherein the cooling air volume is increased in steps. The regulation of the cooling air directed through the bulk material is had by suitable design for the plenum chamber beneath the cooling bucket.

In practicing the present invention it is desirable that the volume of cooling air passed through the hot bulk material proximate the charging end of the cooling apparatus be about 30 to 70%, and preferably 50 percent of the volume of cooling air forced through the material proximate the discharge end of the cooling apparatus. Such operation will reduce the dust content above the cooling buckets substantially.

The preferred cooling apparatus for carrying out this process includes open cooling buckets travelling on straight or circular tracks whereby a gaseous media penetrates the cooling buckets. At least one throttling means is disposed in a gas-tight plenum chamber located beneath the cooling buckets and communicating therewith, and at least one blower means is connected to the plenum chamber, preferably proximate the discharge end of the cooling apparatus. The throttling means in the plenum chamber is used to adjust the volume of cooling media which is forced through the bulk material at various zones along the travel length of the cooling apparatus. The blower means which can be a single blower or a plurality of blowers can then be arranged proximate the discharge portion of the cooling apparatus to increase the volume of cooling media flowing through the bulk material from the charging end to the discharging end. Such an apparatus eliminates the need for many individual blowers and gas ducts as described in the aforementioned prior art apparatus. The apparatus of the present invention employs a simplified design for the plenum chamber which permits an elimination of duplicative blowers and duct work.

In the embodiment of the present invention the throttling means comprises a partition wall having a variable orifice therethrough. The use of such a partition wall with a variable orifice permits accurate regulation of the flow of cooling media to minimize the dust emission. In another embodiment, the plenum chamber can be divided up by a plurality of partition walls having variable orifices resulting in three distinct zones of different lengths, and preferably having a length ratio of 1:2:7 respectively for the first zone proximate the charging end, for the second intermediate zone, and for the third zone proximate the discharge end of the cooling apparatus. A significant reduction in the amount of evolved dust can thus be achieved.

BRIEF DESCRIPTION OF THE DRAWINGS

The invention is further described by means of the drawings wherein in

DESCRIPTION OF THE PREFERRED EMBODIMENT

Figure 1:
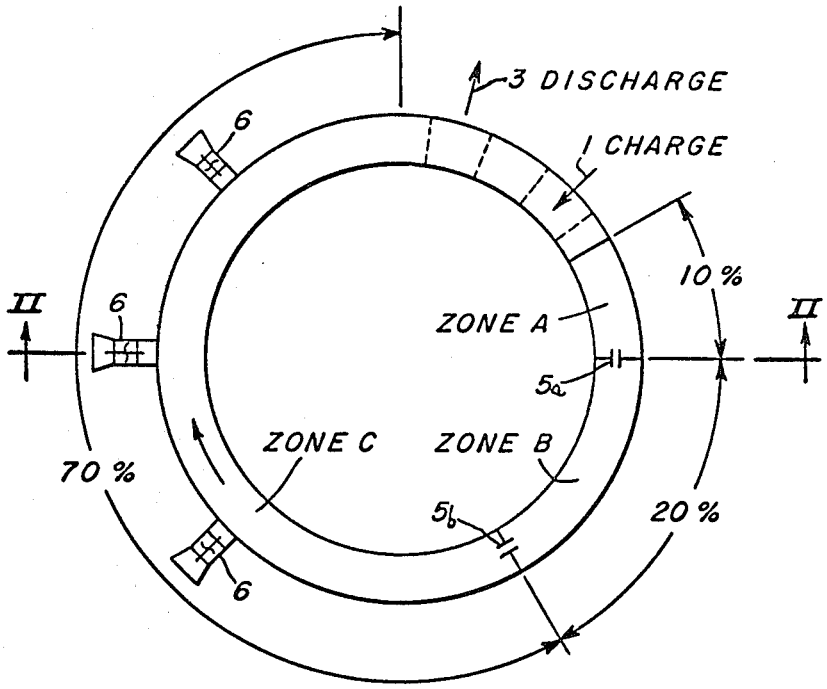
FIG. 1 is a schematic representation of a circular ring-type cooling apparatus.

FIG. 1 shows a circular cooling apparatus in schematic form. The hot bulk material which is typically a sintered ore is charged at 1 into the air permeable cooling bucket 2. A plurality of individual cooling buckets 2 are provided to receive the hot bulk material with the cooling buckets fitting about a circular track. The cooling buckets 2 advance around the circular track and the cooled material is discharged at discharge end 3. A plenum chamber 4 is disposed beneath the circular track and cooling buckets 2, communicating with the bottom of the cooling buckets. The plenum chamber 4 is divided by partition walls 5a and 5b, each having a variable orifice 7 which is by way of example a rotatable throttle. The plenum chamber 4 is thus divided up into three distinct zones A, B and C of various lengths and corresponding volumes, with the length and volume ratios of A:B:C being 1:2:7. The plenum chamber 4 extends along the entire travel path about the circular track from the charging zone at 1 to the discharging zone at 3. A plurality of blower means at 6 are provided in zone C to supply cooling air to the plenum chamber 4. The blowers 6 are brought through the side wall of the plenum chamber of the cooling apparatus.

Figure 4:
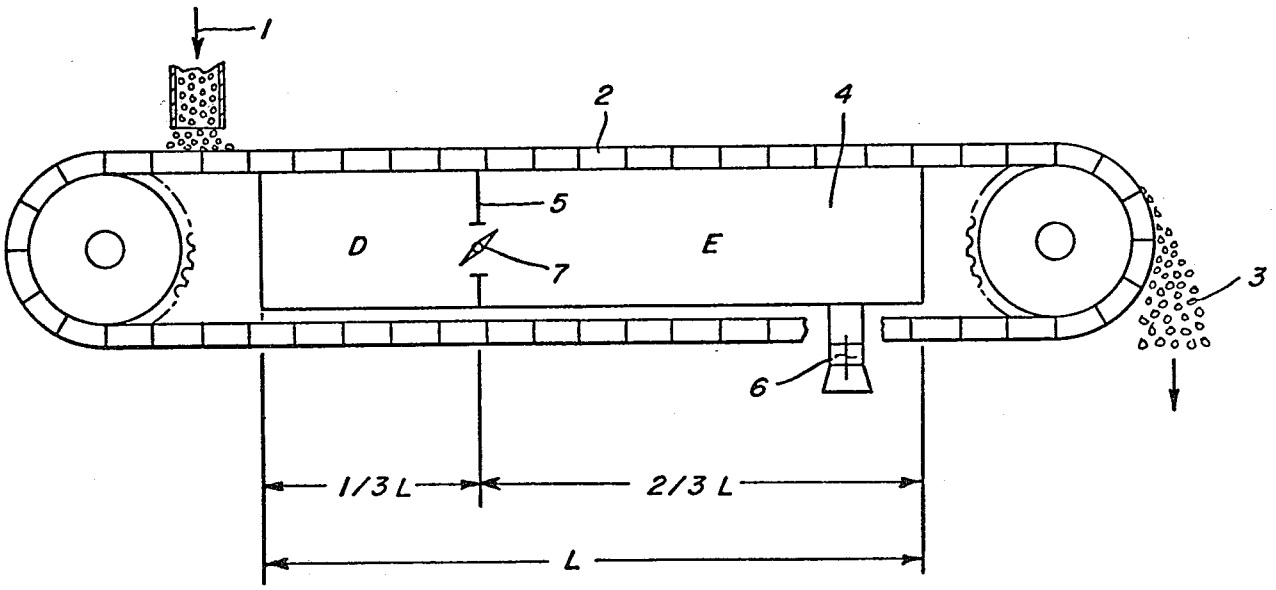
FIG. 4 is a schematic representation of an alternate embodiment which is a straight line cooling apparatus.

An alternative embodiment cooling apparatus is shown in FIG. 4 as a straight line cooling apparatus. In this embodiment the plenum chamber 4 is divided by a single partition wall 5 with a variable orifice 7 here shown as a rotatable flap or throttle valve. The partition wall 5 divides plenum chamber 4 into two areas E and D which have a length and volume ratio of 1:2.

EXAMPLE

Figure 2:
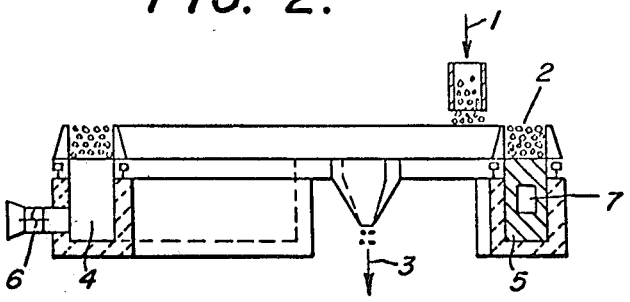
FIG. 2 is a view in section taken along lines II-II of FIG. 1.
Figure 3:
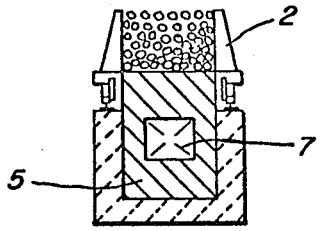
FIG. 3 is an enlarged partial sectional view taken through a cooling bucket and plenum wall.
Figure 5:
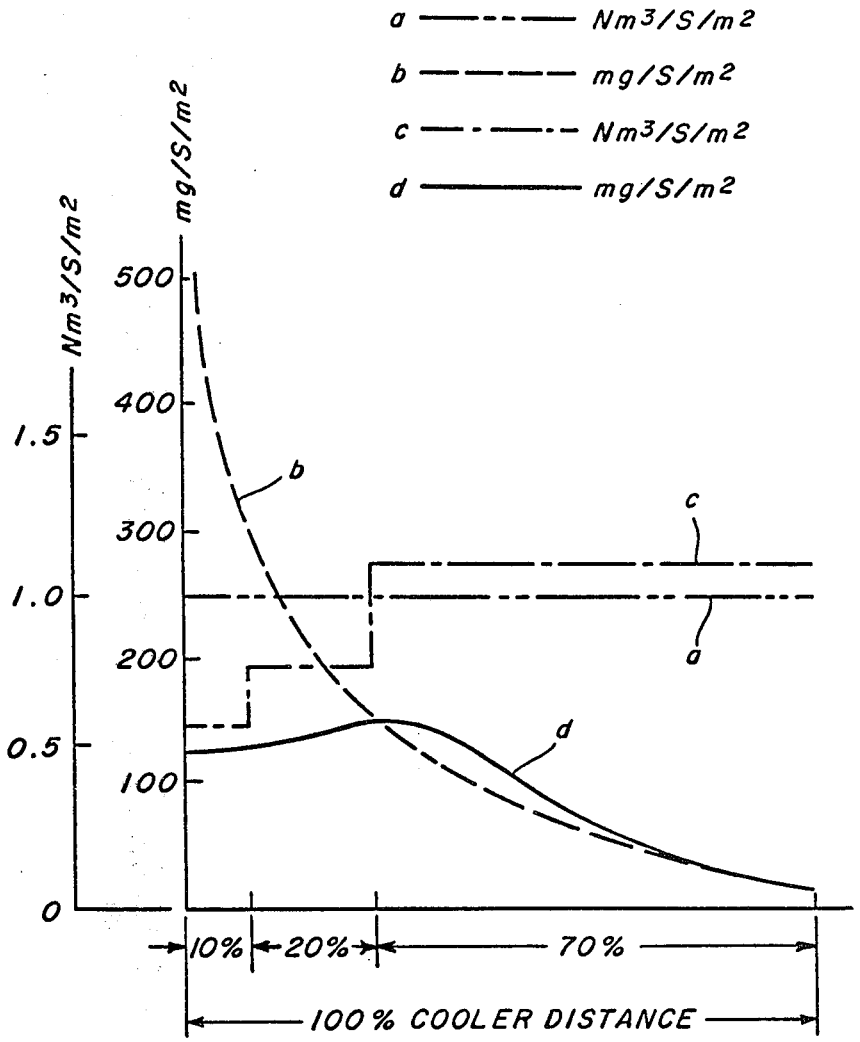
FIG. 5 is a graphic illustration plotting the evolved dust in milligrams per second per square meter and cooling air flow in normal cubic meters per second per square meter against percentage of cooling surface.

A circular cooling apparatus as generally shown in FIGS. 1 through 3 was initially operated without any partition walls 5 disposed in the plenum chamber and was charged with material from a sinter plant which was initially at a temperature of about 700° to 900°C. Ten blowers supplied cooling air at a temperature of 10° to 30°C to the plenum chamber in a volume of about 200 normal cubic meters per second to force the cooling air through the hot bulk material in the cooling buckets which material had a total cross sectional area of about 200 square meters along the travel path of the cooling apparatus. The air was uniformly distributed in the plenum chamber throughout the cooling area so that the material was permeated uniformly along the length of the cooling apparatus. The specific volume of cooling air in normal cubic meters per second per square meter for the cooling area is charted as curve *a* on FIG. 5. This is plotted against the cooling surface or cooling distance along the travel path from the beginning of the cooling apparatus at the charging end to the discharge end. Curve *b* of FIG. 5 shows the dust emission above the specific portion of the cooling apparatus in a quantity of milligrams per second per square meter and ranges from about 500 milligrams per second per square meter at the charging end of the cooling apparatus to less than 10 milligrams per second per square meter at the discharge end of the cooling apparatus. It can be seen that the dust developed in the first portion of the cooling apparatus is considerable and presents a serious nuisance to personnel in the vicinity of the cooling apparatus. By installing the throttling devices of the invention as explained with respect to the Figures the circular cooling apparatus as shown in FIG. 1 is divided into three zones A, B, and C as already explained. The specific volume of cooling air forced through the bulk material in the individual zones is seen as curve *c* in FIG. 5. The specific volume of cooling air increases from approximately 0.6 normal cubic meters per second per square meter in zone A to about 0.8 cubic meters per second per square meter in zone B to about 1.1 normal cubic meters per second per square meter in zone C. It was possible to reduce the dust content at the charging end to less than 110 milligrams per second per square meter, as can be seen from curve *d* of FIG. 5. The amount of dust evolved increased at the beginning of zone C to about 150 milligrams per second per square meter and was subsequently reduced proximate the discharge end of zone C finally to less than 10 milligrams per second per square meter. A further and more acurate adjustment resulting in greater control of the dust emission is possible by varying the orifices 7 in the divider walls for example with a rotatable throttle as shown in FIG. 4.

I claim:

1. In the process of cooling hot bulk materials such as sintered ore which is charged into gas-permeable cooling buckets at a charging zone and advanced in said buckets through a cooling zone and discharged from the buckets at a discharge zone, which buckets are in communication with a plenum chamber, said plenum chamber being provided with at least one throttling means disposed between the charging zone and the discharge zone, wherein cooling gas is forced via blower means into the plenum chamber and through the hot bulk material disposed in the gas-permeable buckets, the improvement comprising:

adjusting said throttling means such that the volume of cooling gas forced through the bulk material between the charging zone and the throttling means is less than the volume of cooling gas forced through the bulk material between the throttling means and the discharge zone, whereby the particulate emission from the bulk material is substantially reduced.

2. The improvement specified in claim 1, wherein the volume of cooling gas forced through the bulk material proximate the charging zone is from 30 to 70 percent of the volume of air forced through the bulk material proximate the discharge zone.

3. The improvement specified in claim 1, wherein the volume of cooling gas forced through the bulk material proximate the charging zone is preferably about 50 percent of the volume of air forced through the bulk material proximate the discharge zone.

4. The improvement specified in claim 1, wherein the cooling gas is air at a temperature of about 10° to 30°C.

* * * * *